US005427463A

United States Patent [19]

Bastiansen et al.

[11] Patent Number: 5,427,463

[45] Date of Patent: Jun. 27, 1995

[54] INK WRITING IMPLEMENT

[75] Inventors: Bernd Bastiansen, Hamburg; Hans-Joachim Ahrens, Wernigerode, both of Germany

[73] Assignee: Rotring International GmbH & Co. KG, Hamburg, Germany

[21] Appl. No.: 168,124

[22] Filed: Dec. 17, 1993

[30] Foreign Application Priority Data

Dec. 18, 1992 [DE] Germany ..... 42 43 686.9

[51] Int. Cl.[6] ..... B43K 5/02; B43K 5/18; B43K 8/18

[52] U.S. Cl. ..... 401/134; 401/135; 401/227; 401/258

[58] Field of Search ..... 401/132, 133, 134, 135, 401/258, 209, 199, 227, 229, 241

[56] References Cited

U.S. PATENT DOCUMENTS

| | | | |
|---|---|---|---|
| 3,233,594 | 2/1966 | Zepell | 401/241 X |
| 3,687,561 | 8/1972 | Phillips | 401/134 |
| 4,382,707 | 5/1983 | Anderka | 401/135 X |
| 4,549,828 | 10/1985 | Anderka et al. | 401/258 |
| 4,588,319 | 5/1986 | Niemeyer | 401/199 X |
| 4,728,214 | 3/1988 | Mutschler | 401/258 |
| 4,990,012 | 2/1991 | Groetsch et al. | 401/134 |
| 5,172,995 | 12/1992 | Felgentreu | 401/258 |

FOREIGN PATENT DOCUMENTS

| | | | |
|---|---|---|---|
| 0380696 | 8/1990 | European Pat. Off. . | |
| 2624436 | 6/1989 | France . | |
| 1278882 | 9/1968 | Germany | 401/132 |
| 2538427 | 3/1977 | Germany | 401/135 |
| 3300401 | 7/1983 | Germany . | |
| 3244697 | 6/1984 | Germany . | |
| 3445944 | 6/1986 | Germany . | |
| 232098 | 9/1989 | Japan | 401/134 |
| 7907389 | 4/1981 | Netherlands . | |

*Primary Examiner*—Steven A. Bratlie
*Attorney, Agent, or Firm*—Fitzpatrick, Cella, Harper & Scinto

[57] ABSTRACT

An ink writing implement has a front part with a writing tip that comes into contact with the writing substrate, and a writing fluid cartridge whose interior chamber containing the writing fluid is tightly sealed before being put into use, and which is connected to the front part during use. There is also provided an equalization system disposed inside a housing and connected by one end to the interior chamber of the writing fluid cartridge and by the other end with the outside air. The writing fluid cartridge and front part are rigidly attached to one another. The front part can be inserted into the equalization system through a back opening and moved into a position in which it protrudes beyond the front opening in the housing.

12 Claims, 3 Drawing Sheets

INK WRITING IMPLEMENT

BACKGROUND OF THE INVENTION

1. Field of the Invention

The invention relates to an ink writing implement having a front part with a writing tip that comes into contact with the writing substrate, and a writing fluid cartridge whose interior space containing the writing fluid is sealingly closed before being put into use, and which is connected to the front part during use. Furthermore, the implement has an equalization system disposed in a housing that has a front opening for the passage of the front part and, when the pen is in use, which is in contact at one end with the interior chamber of the writing fluid cartridge and at the other end with ambient air.

2. Related Background Art

In a known writing implement of this type (German Published, Non-Examined Patent Application DE-OS 32 44 697, equivalent to U.S. Pat. No. 4,549,828), in which the writing fluid reservoir can also be embodied as a writing fluid cartridge, a sleeve element that forms the equalizing system together with the defining walls of the housing part is provided between the front part and a housing that encloses it. The writing fluid cartridge is placed on the back end of the front part, and rests with its front end wall against the back end of the sleeve element. In this known writing implement, the writing fluid cartridge can be pulled away from the front part toward the rear, so that it can be replaced through the insertion of a new writing fluid cartridge. For cleaning purposes, the front part can be pulled forward out of the housing part so that, if the writing fluid cartridge has already been removed, only the sleeve element remains inside the housing. This part can then be removed by pulling it out from the housing part toward the rear.

In the known writing implement it is assumed that the user normally replaces the writing fluid cartridge after the writing fluid has been used up, and that he also occasionally removes the front part to clean it.

However, in many cases it is desirable to replace the front part along with the writing fluid cartridge. In this way, when inserting a new writing fluid cartridge, the user can also remove those parts in which writing fluid deposits might be present that could hamper further operation after insertion of a new writing fluid cartridge.

OBJECT AND SUMMARY OF THE INVENTION

An object of the invention is to embody a writing implement of the type mentioned, such that the writing fluid cartridge and front part are fixedly attached to one another, whereby the front part can be inserted into the equalization system through a back opening and moved until it reaches a position in which it protrudes beyond the front opening in the housing.

In a writing implement according to the invention, the writing fluid cartridge and front part form one unit, whereby the user also replaces the front part when replacing the writing fluid cartridge. Hence, the user will also have a new writing tip at his disposal when using a new writing fluid cartridge. Furthermore, the equalization system, which is frequently comprised of high-grade plastic and is produced at relatively high cost, remains inside the writing implement. The equalization system is used together with the new writing fluid cartridge and the new front part.

The equalization system of a writing implement in accordance with the invention preferably also has a lamellar body with a penetrating tubular piece for receiving the front part.

In one embodiment of the invention, the front part can be moved out of a guarded position, in which the interior chamber of the writing fluid cartridge connected to it is tightly sealed, into an operating position. The back end of the front part breaks the seal of the interior chamber in the operating position. In this way, a connection of the interior chamber of the writing fluid cartridge to the writing tip is produced. If the lamellar body has a penetrating tubular piece for receiving the front part, an opening that is connected to the one end of the equalization system can be provided in the wall of the tubular piece.

With a design of this type, a positioning arrangement for axially securing the front part in the equalization system can be provided in order to obtain a defined holding of the front part in the equalization system. This arrangement also affords adequate support against axial forces during writing or drawing, particularly when the pen is used in compasses or plotters. This arrangement can have a projection that is embodied on the front part, for example, which will cooperate with an axial slit that is open at one end and has a crosswise-extending contact region at its closed end. In this manner, the projection can be inserted into the open end of the axial slit when the front part is inserted into the equalization system. When the front part has reached its end position, the projection can be displaced by means of a twisting motion into the contact region, in which it is supported against axial movements.

According to another embodiment of the invention, it also is possible to embody the writing fluid cartridge and front part in one piece. With this type of design, an opening device can be disposed at the equalization system to produce a connection between the front part and the interior chamber of the writing fluid cartridge when the front part is inserted into the equalization system. In this case, a connection would not be effected via an interior chamber of the front part.

The opening device can comprise a tubular section that projects backwards beyond the equalization system and which produces the connection to the interior chamber of the writing fluid cartridge by breaking the seal that sealingly closes the cartridge. The invention now will be explained in more detail below, in conjunction with drawing figures that show exemplary embodiments.

DETAILED DESCRIPTION OF THE PREFERRED EMBODIMENTS

Figure 1:
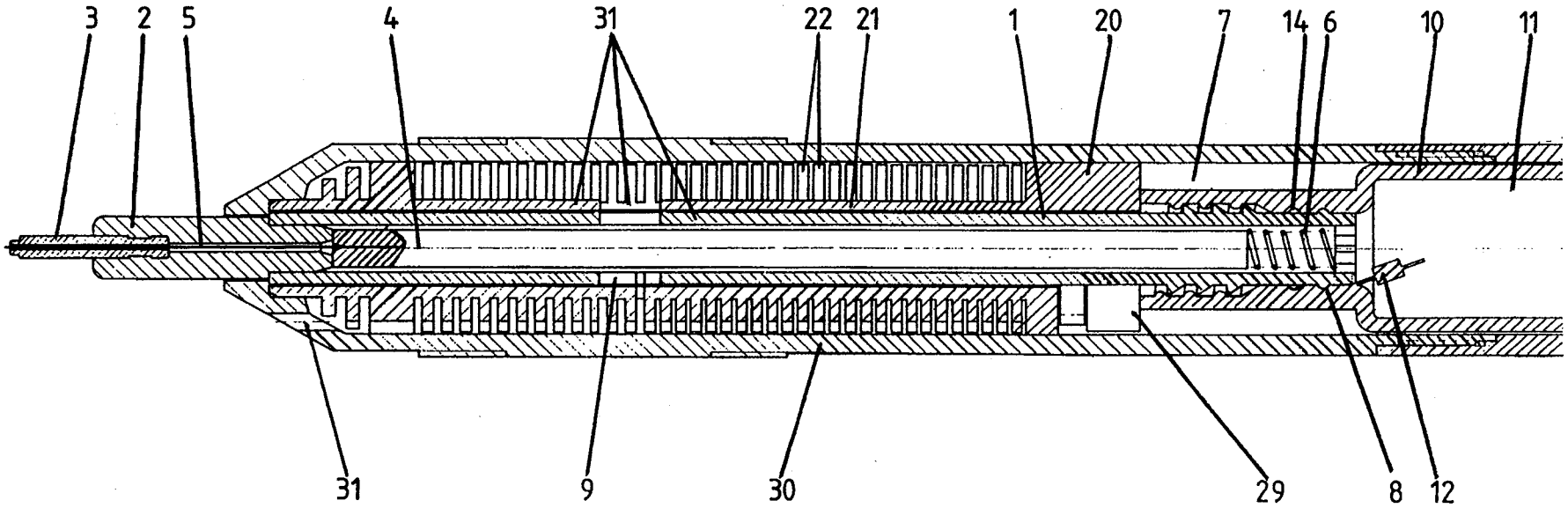
FIG. 1 shows a partial section through a writing implement in the form of a stylus pen.
Figure 2:
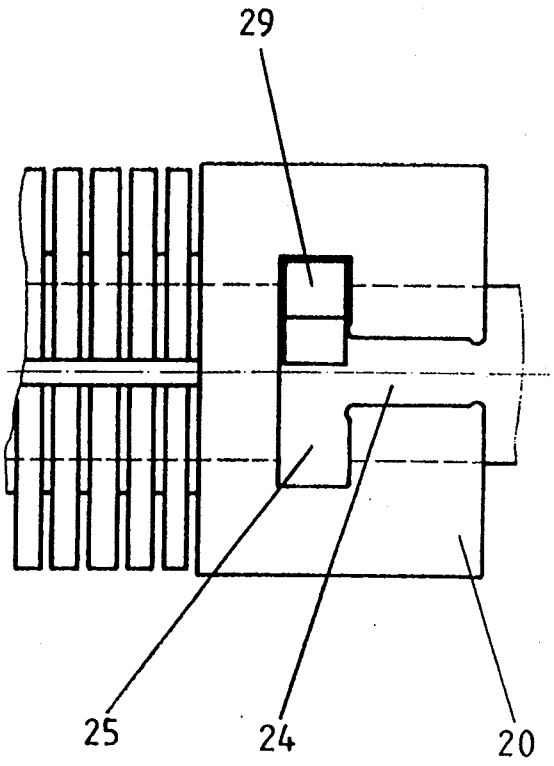
FIG. 2 shows, in a partial representation, the positioning arrangement of the writing implement in accordance with FIG. 1.

The technical or stylus pen shown in FIGS. 1 and 2 has a front part comprised of a tubular section 1, a transitional section 2 secured in its front end, and a conventional writing tube 3 secured in the front end of the transitional section 2. A drop-weight body 4, which is pressed forward by a spring 6 but is limited in its axial back-and-forth movement, is located inside the tubular section 1. A cleaning wire 5 extending into the writing tube 3 is secured in the front end of the drop-weight body 4.

Sawtooth-shaped projections 7, to engage corresponding indentations in the neck section of a writing fluid cartridge 10, are embodied on the outside of the back end region of the tubular section 1 of the front part. As shown, the sawtooth-shaped projections 7 of the tubular section 1 and corresponding indentations in the neck section of the writing fluid cartridge 10 connect the front part and the writing fluid cartridge 10 so that they are inseparable. A user cannot pull the tubular section 1 out of the neck section of the writing fluid cartridge 10.

In a storage position (not shown), an annular rib 8 is provided behind the sawtooth-shaped projections 7 on an outside surface of the tubular section 1, so as to engage an annular groove 14 in the neck section of the writing fluid cartridge 10. In this manner, the back end of the tubular section 1 is at a distance from a seal 12 so as to sealingly close the outlet opening of the interior chamber 11 of the writing fluid cartridge 10.

As also shown, the front part is pushed through a lamellar body 20 that has an essentially penetrating tubular part 21. Annular equalization conduits 22 are formed on the outside of the tubular part by lamellar that are connected to one another in a conventional way. The front ends of the equalization chambers are formed by an axial conduit 23 (not shown), and the back ends are formed by means of the connection to the interior chamber of the tubular section 1 of the front part, via a transverse bore 9. The writing fluid exiting through the transverse bore 9 is supplied to the individual lamellar via a distributor tube. The lamellar body 20 is securely seated in a housing 30 that has a through-opening at its front end, through which extends the transition section 2 of the front part that supports the writing tube 3.

When a user wishes to insert a new front part and a new writing fluid cartridge 10 into the unit comprising the housing 30 and a lamellar body 20, the front part is pushed through the tubular part 21 of the lamellar body 20 from behind until the annular shoulder formed by the tubular section 1 of the front part impacts upon the back edge of the front opening of the housing 30. During this insertion of a front part connected to a writing fluid cartridge 10, a projection 29 that is provided on the outside of the tubular section 1 of the front part is guided into an axial slit 24 (FIG. 2). The slit is open to the back and is provided in the lamellar body 20. The projection travels until it reaches a contact region 25 extending crosswise to the axial slit 24. For axial positioning of the front part, the user twists the front part with respect to the lamellar body 20 in such a way that the projection 29 leaves the region of the axial slit 24 and is secured axially in both directions by the defining walls of the contact region 25. In this secured position, the user then presses the writing fluid cartridge 10 forward, so that the annular rib 8 of the tubular section 1 is pressed out of an annular groove 14 within the neck section of the writing fluid cartridge 10 and reaches the annular groove of the neck section located behind it, as can be seen in FIG. 1. Of course, in the process the sawtooth-shaped projections 7 are also displaced backward into the position shown. Moreover, the back end of the tubular section 1 penetrates the seal 12 so that the interior chamber 11 of the writing fluid cartridge 10 is connected to the interior chamber of the tubular section 1, and thus is connected on one side to the writing tube 3 and on the other side to the equalization chamber via the transverse opening 9. In this way writing fluid travels to the writing tube 3, and the interior chamber 11 of the writing fluid cartridge 10 is connected to the ambient air via the transverse opening 9, the equalization chamber, and an opening 31 provided in the front end of the housing 30.

When the fluid in the writing fluid cartridge 10 has been used up, or the cartridge is to be replaced for other reasons, the user pulls the writing fluid cartridge 10, including the front part, backward out of the lamellar body 20. In the described manner, the user then inserts a new unit comprising a front part and a writing fluid cartridge 10, usually after the equalization system to be reused has been thoroughly cleaned.

Figure 3:
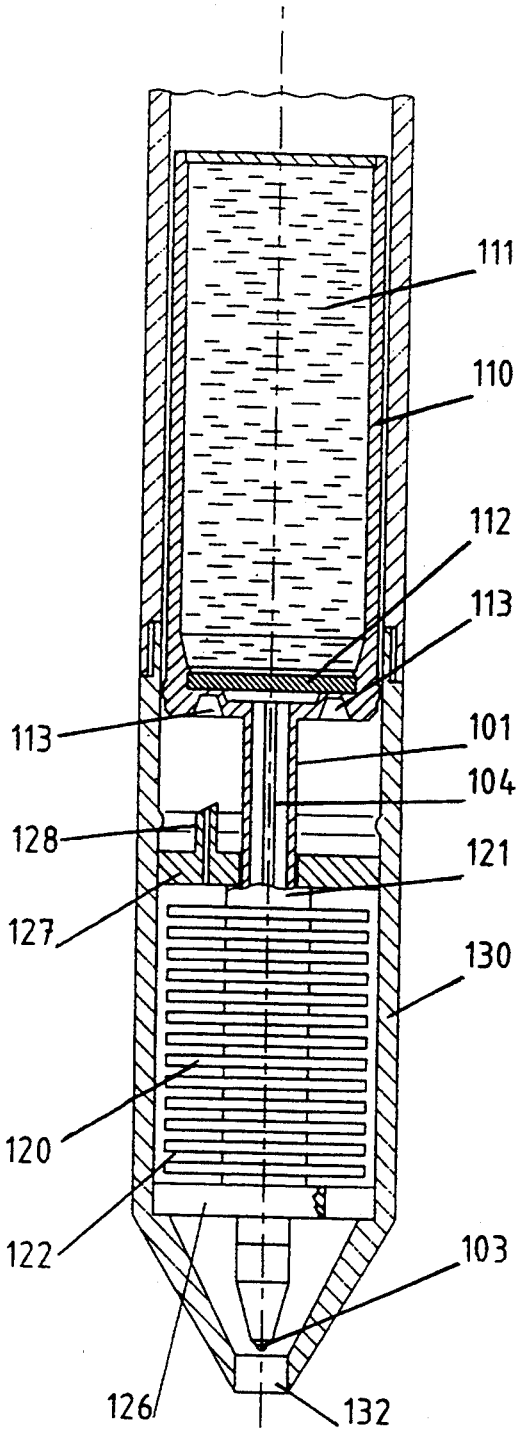
FIG. 3 shows a section of a different exemplary embodiment of a writing implement in which the interior chamber of the writing fluid cartridge is still in a sealed state.
Figure 4:
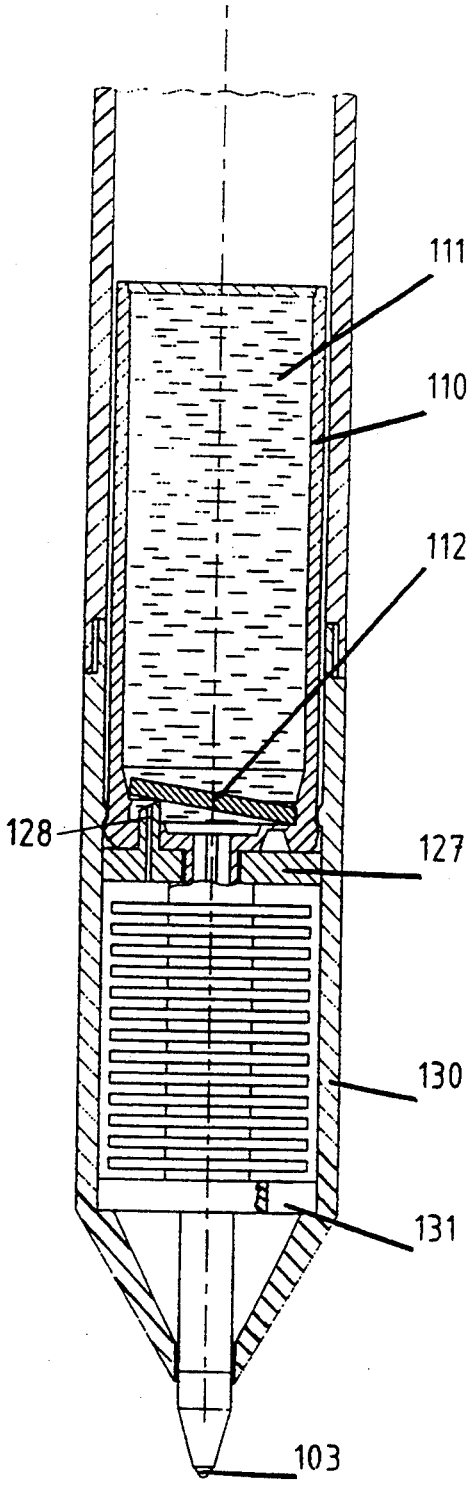
FIG. 4 shows the writing implement of FIG. 3 in an operational state.

In the exemplary embodiment in accordance with FIGS. 3 and 4, the writing implement has the shape of a rolling ball ink pen having a ball 103 at the front end of its front part 101 that acts as a writing tip. The tubular front part 101 is embodied in one piece with the ink cartridge 110. The interior chamber 111 of the ink cartridge 110 is sealed with respect to the back end of the front part 101 by means of a diaphragm 112 extending from the front wall of the ink cartridge 110.

The lamellar body 120 forming an equalization system has typical equalization chambers 122, and is defined at its front end by an annular body 126 and at the back end by an annular body 127, between which extends a tubular part 121. The lamellar body 120 is securely seated in a housing 130, which has a front opening 132 that is connected to the equalization system via an axial conduit 131 in the front annular body 126 of the lamellar body 120. A backwardly-projecting tubular section 128 whose back end tapers to form a sort of cutting edge is embodied in the rear annular body 127.

In the position shown in FIG. 3, the front part 101 is pushed into the tubular part 121 of the lamellar body 120. However, the writing tip 103 is still inside the housing 130, and the interior chamber 111 of the ink cartridge 110 is still sealingly closed by the diaphragm 112.

In order to bring the ballpoint ink pen into the operating position, the unit comprising front part 101 and ink cartridge 110 in the housing 130 is pushed forward out of the position in FIG. 3 and into the position in FIG. 4. In the process, the tubular section 128 pierces one of the predetermined puncture points formed by indentations 113 in the front wall of the ink cartridge, and releases the diaphragm 112 from its sealed position, so that writing fluid can enter into the back end of the front part 101 and reach the writing tip 103. Moreover, a connection of the interior chamber 110 to the equalization system 120 is produced via the tubular section 128.

While preferred embodiments of the invention have been shown and described, the invention is to be defined by the scope of the appended claims.

We claim:

1. An ink writing implement, comprising:

a front part (1,2;101) comprising a writing tip (3;103) that comes into contact with a writing substrate;

a writing fluid cartridge (10;110) having an interior chamber containing writing fluid, wherein the interior chamber is-tightly sealed before being put into use, and wherein the interior chamber is connected to said front part (1,2;101) during use;

a housing (30;130) having a front opening (132) for the passage of said front part (1,2;101);

a seal (112) for sealingly closing said writing fluid cartridge (10;110); and an equalization system (20;120) disposed in said housing, wherein when said implement is in use, a first end of said equalization system contacts the interior chamber (11;111) of said writing fluid cartridge, and a second end of said equalization system contacts ambient air, said equalization system comprising a tubular opening device (128);

wherein said writing fluid cartridge (10;110) and said front part (1,2;101) are fixedly attached to one another, and wherein said front part (1,2;101) can be inserted into said equalization system (20;120) through a back opening and moved until it reaches a position in which it protrudes beyond the front opening (132) in said housing (30;130), and wherein when said front part is moved so that it reaches the position, said opening device (128) breaks said seal (112) to produce (i) a connection between the interior chamber (11;111) of said writing fluid cartridge (10;110) and said front part (101) and (ii) a connection between the interior chamber (11;111) of said writing fluid cartridge (10;110) and said equalization system (20;120) through said opening device (128).

2. An implement according to claim 1, wherein said equalization system (20; 120) comprises a lamellar body that comprises a penetrating tubular part (21; 121) for receiving said front part (1, 2; 101 ).

3. An implement according to claim 1, wherein said seal (112) seals the interior chamber of said writing fluid cartridge, and wherein said front part (1,2) can be moved out of a storage position in which the interior chamber (11) of said writing fluid cartridge (10;110) connected thereto is sealingly closed by said seal (112), and into a position in which said opening device (128) has broken said seal (112).

4. An implement according to claim 3, further comprising a positioning arrangement (24, 25, 29) for axially securing said front part (1, 2) in said equalization system (20;120).

5. An implement according to claim 4, wherein said positioning arrangement comprises a projection (29) that cooperates with an axial slit (24) which is open at one end and has a crosswise-extending contact region (25) at its closed end.

6. An implement according to claim 2, wherein said seal (112) seals the interior chamber of said writing fluid cartridge (10;110), and wherein said front part (1, 2) can be moved out of a storage position in which the interior chamber (11) of said writing fluid cartridge (10;110) connected thereto is sealingly closed by said seal (112), and into a position in which said opening device has broken said seal (112).

7. An implement according to claim 6, further comprising a positioning arrangement (24, 25, 29) for axially securing said front part (1, 2) in said equalization system (20; 120).

8. An implement according to claim 7, wherein said positioning arrangement comprises a projection (29) that cooperates with an axial slit (24) which is open at one end and has a crosswise-extending contact region (25) at its closed end.

9. An implement according to claim 1, wherein said writing fluid cartridge (110) and said front part (101) are embodied in one piece.

10. An implement according to claim 9, wherein said opening device (128) comprises a section that projects backwardly beyond said equalization system (120) and breaks said seal (112) to produce the connection to the interior chamber (111) of said writing fluid cartridge (10;110).

11. An implement according to claim 2, wherein said writing fluid cartridge (110) and said front part (101) are embodied in one piece.

12. An implement according to claim 11, wherein said opening device (128) comprises a section that projects backwardly beyond said equalization system (120) and breaks said seal (112) to produce the connection to the interior chamber (111) of said writing fluid cartridge (10;110).

* * * * *